US009930981B2

(12) United States Patent
Wheeler et al.

(10) Patent No.: US 9,930,981 B2
(45) Date of Patent: Apr. 3, 2018

(54) CUP LID APPARATUS

(71) Applicants: David C Wheeler, Barrington, IL (US); Jeffrey M Morris, Lincolnshire, IL (US)

(72) Inventors: David C Wheeler, Barrington, IL (US); Jeffrey M Morris, Lincolnshire, IL (US)

( * ) Notice: Subject to any disclaimer, the term of this patent is extended or adjusted under 35 U.S.C. 154(b) by 204 days.

(21) Appl. No.: 13/862,839

(22) Filed: Apr. 15, 2013

(65) Prior Publication Data

US 2014/0305953 A1 Oct. 16, 2014

(51) Int. Cl.
*A47G 19/22* (2006.01)
*B65D 47/04* (2006.01)
(Continued)

(52) U.S. Cl.
CPC ..... *A47G 19/2272* (2013.01); *B65D 47/043* (2013.01); *B65D 47/0852* (2013.01)

(58) Field of Classification Search
CPC ..... A47G 19/2272; A47G 19/2205; B65D 2543/00046; B65D 47/043; B65D 47/0852
(Continued)

(56) References Cited

U.S. PATENT DOCUMENTS 4,619,372 A * 10/1986 McFarland ..... 220/713
6,070,755 A * 6/2000 Evans et al. ..... 220/793
(Continued)

*Primary Examiner* — J. Gregory Pickett
*Assistant Examiner* — Niki Eloshway
(74) *Attorney, Agent, or Firm* — Jeffrey M. Morris

(57) ABSTRACT

A cup lid for use with a drinking cup containing a liquid, the cup having a base and a sidewall extending upwardly from the base, the sidewall including an inner surface, a top end, and a rim extending along the circumference of the top end. A first part lying in a first plane and having a top surface. Means on said first part for releasably mounting said first part to the top end of the cup to form a substantially liquid tight seal between the cup lid and the cup. A second part depends radially outwardly from said first part and lies in a second plane. A longitudinal axis and a distal end on said second part. Means on the second part for movement relative to said first part. Compartment means is formed between the inner surface of the cup and the second part for allowing liquid in the cup to flow into the compartment and out of the compartment. The second part comprises baffle means for shielding the liquid in the compartment means from substantial interference with most of the liquid outside the compartment means during movement of the cup whereby spillage of liquid out of the cup is minimized. Hinge means on the second part and traversing the second part for preventing the tearing of the second part during the movement of the second part. A tab on said first part for movement from a first position where the tab is mounted on the rim of the cup to prevent the liquid from escaping from the compartment and a second position where the tab is not mounted on the rim to allow the liquid to escape from the compartment. A reservoir located on the bottom surface of the lid and comprising a hollow inside volume which is covered when the tab is in the first position and which is at least partially covered when the tab is in the second position. A structure is on the top surface of the second part which interferes with the flow of the liquid as it moves into the compartment and out of the compartment. A clasp located on the bottom surface of the first part of the cup lid. The clasp comprises means for releasably holding the distal end of the second part when the second part is moved from it second position near the bottom surface of the first part.

10 Claims, 6 Drawing Sheets

(51) Int. Cl.
*B65D 47/08* (2006.01)
*A47G 19/23* (2006.01)

(58) Field of Classification Search
USPC ..... 220/711, 712, 713, 716, 719
See application file for complete search history.

(56) References Cited

U.S. PATENT DOCUMENTS

| | | | | |
|---|---|---|---|---|
| 6,260,727 | B1 * | 7/2001 | Durdon | 220/254.3 |
| 6,394,302 | B1 * | 5/2002 | Query, Jr. | 220/707 |
| 7,275,652 | B2 | 10/2007 | Morris et al. | |
| D612,237 | S * | 3/2010 | Richey | D9/447 |
| 2002/0079314 | A1 * | 6/2002 | Lukacevic | 220/254.3 |
| 2005/0072787 | A1 * | 4/2005 | Morris et al. | 220/712 |
| 2005/0087539 | A1 * | 4/2005 | Waller | 220/713 |
| 2008/0283537 | A1 * | 11/2008 | Smith et al. | 220/713 |
| 2010/0108701 | A1 * | 5/2010 | Lee et al. | 220/719 |

* cited by examiner

Fig 2
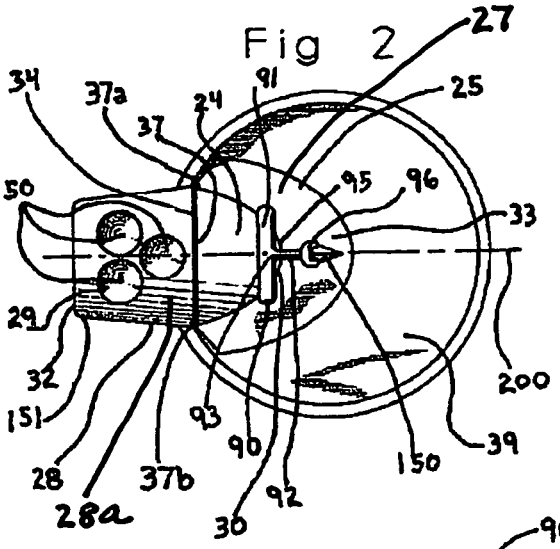
Fig 3
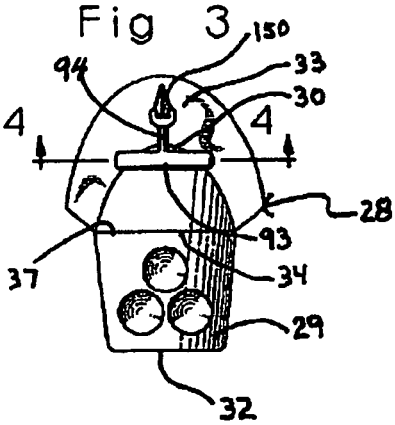
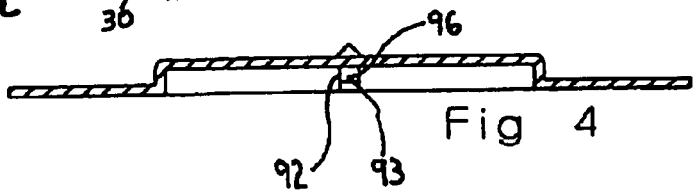
Fig 4
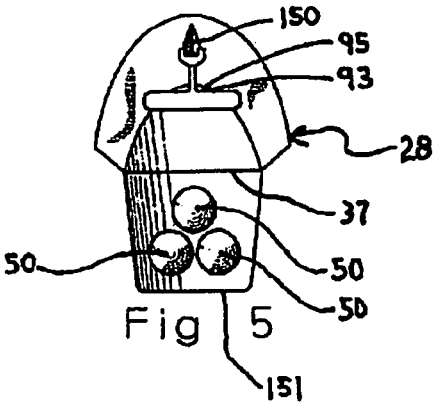
Fig 5

Fig 6
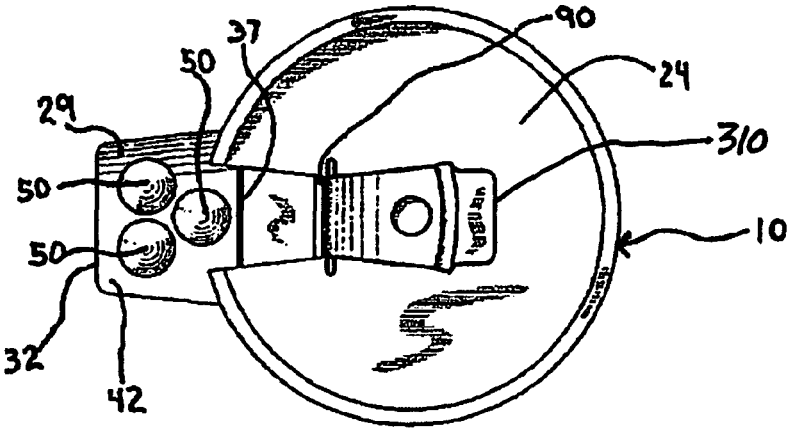
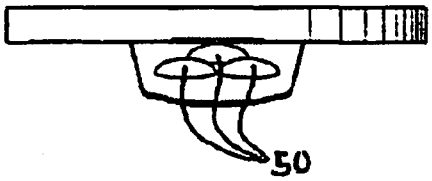
Fig 7
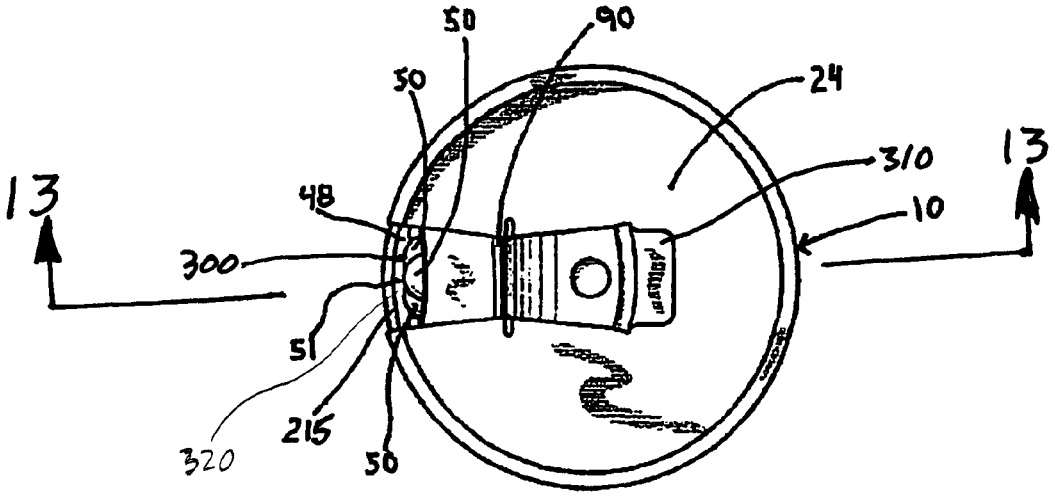
Fig 8

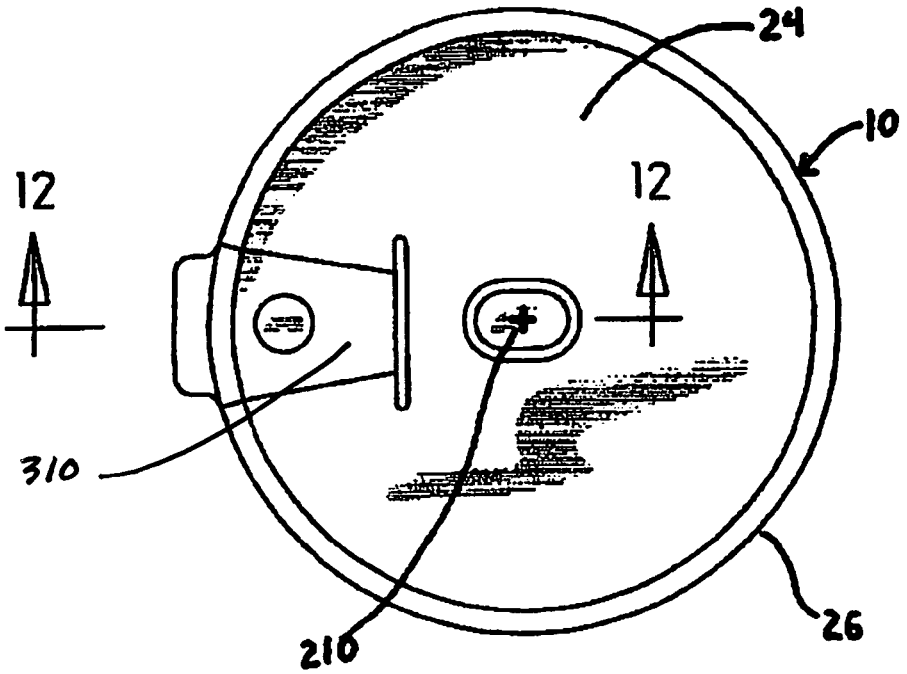
Fig 11
Fig 12
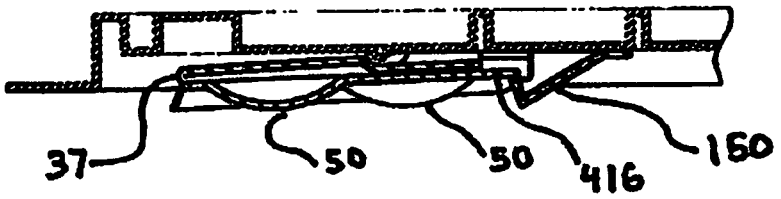

CUP LID APPARATUS

BACKGROUND OF THE INVENTION

The present invention relates to a plastic lid for a drinking cup. In particular, the invention relates to a lid having a flexible flange which depends downwardly into the cup and rests contiguously against the cup's inner sidewall surface to form a channel and two apertures through which the contents of the cup may be emptied. The subject matter of the present invention comprises a first channel on the first part; a first container and a second container connected to the first container; latching means on the bottom surface of the first part of the cup lid; and barrier means on the distal end of the first part.

The prior art, such as Morris et al U.S. Pat. No. 7,275,652, discloses a lid which solves many of the disadvantages of using a traditional cup lid. However, the subject matter of the invention disclosed in Morris et al '652 does not offer a solution to the premature tearing of the distal portion of the first part at the point of movement of the first part. Another design solution that the Morris et al '652 invention does not solve is to preclude the spillage of liquid out of the weep hole in the lid. Still further, another design solution that the Morris et al '652 invention does not solve is to offer a latch to hold the distal portion of the first part to facilitate the stacking of the lids during packaging and storage. Still further, another design solution that the Morris et al '652 invention does not solve is to offer a bather on the distal portion of the first part to impede the flow of liquid out of the drinking aperture.

BRIEF SUMMARY OF THE INVENTION

A cup lid for use with a drinking cup containing a liquid, the cup having a base and a sidewall extending upwardly from the base, the sidewall including an inner surface, a top end, and a rim extending along the circumference of the top end and comprising a first part lying in a first plane and having a top surface, means on the first part for releasably mounting the first part to the top end of the cup to form a substantially liquid tight seal between the cup lid and the cup, a second part depending radially outwardly from the first part and lying in a second plane, a longitudinal axis and a distal end on the second part, means on the second part for movement relative to the first part, compartment means formed between the inner surface of the cup and the second part for allowing liquid in the cup to flow into the compartment and out of the compartment, the second part comprising baffle means for substantially shielding the liquid in the compartment means from substantial interference with the liquid outside the compartment means during lateral movement of the cup whereby spillage of liquid out of the cup is substantially minimized, means on the second part and traversing perpendicular to the longitudinal axis of the second part for preventing the tearing of the second part during the movement of the second part. First container means on the second part, second container means on the second part contiguous to the first container means, the first container means having a surface, the second container means having a surface, the surface of the first container means and the surface of the second container means joined at a location on the surface of said first container means and at a location on the surface of the second container means. Barrier means mounted on the second part for impeding a portion of the liquid from flowing directly from the cup out of the drinking aperture. Latching means on said cup lid located near the center axis of rotation of the cup lid. The latching means is located near the center axis of the cup lid and has means for releasably holding the distal end of the second part when the flange is moved to its second position.

These and other objects and advantages of the present invention will be made apparent from the following detailed description of the preferred embodiments, with reference to the accompanying drawing. In the drawing, the same reference numbers are used to identify similar elements in the various embodiments.

BRIEF DESCRIPTION OF THE DRAWING

FIG. 2 is a bottom view of the preferred embodiment of the present invention;

FIG. 3 is a bottom view of the preferred embodiment of the present invention;

FIG. 4 is an elevational cross-sectional view of the preferred embodiment of the present invention taken along line 4-4 of FIG. 3;

FIG. 5 is a top view of the preferred embodiment of the present invention;

FIG. 6 is a top view of the preferred embodiment of the present invention;

FIG. 7 is an elevational view of the preferred embodiment of the present invention;

FIG. 8 is a top view of the preferred embodiment of the present invention;

FIG. 11 is a top view of the preferred embodiment of the present invention;

FIG. 12 is a partial cross sectional view taken along line 12-12 of FIG. 11.

DETAILED DESCRIPTION OF THE INVENTION

A detailed description of the preferred embodiment and best mode for practicing the invention are described herein. While the present invention is described in greater detail relative to the enclosed drawings in which the preferred method of practicing the present invention are shown, it should be acknowledged that persons skilled in the relevant arts may modify certain aspects of the invention herein described while still arriving at the same positive conclusions with regards to this invention. Consequently, the following description is intended to be a general, instructive disclosure and is not intended to be restrictive upon the present invention.

Figure 1:
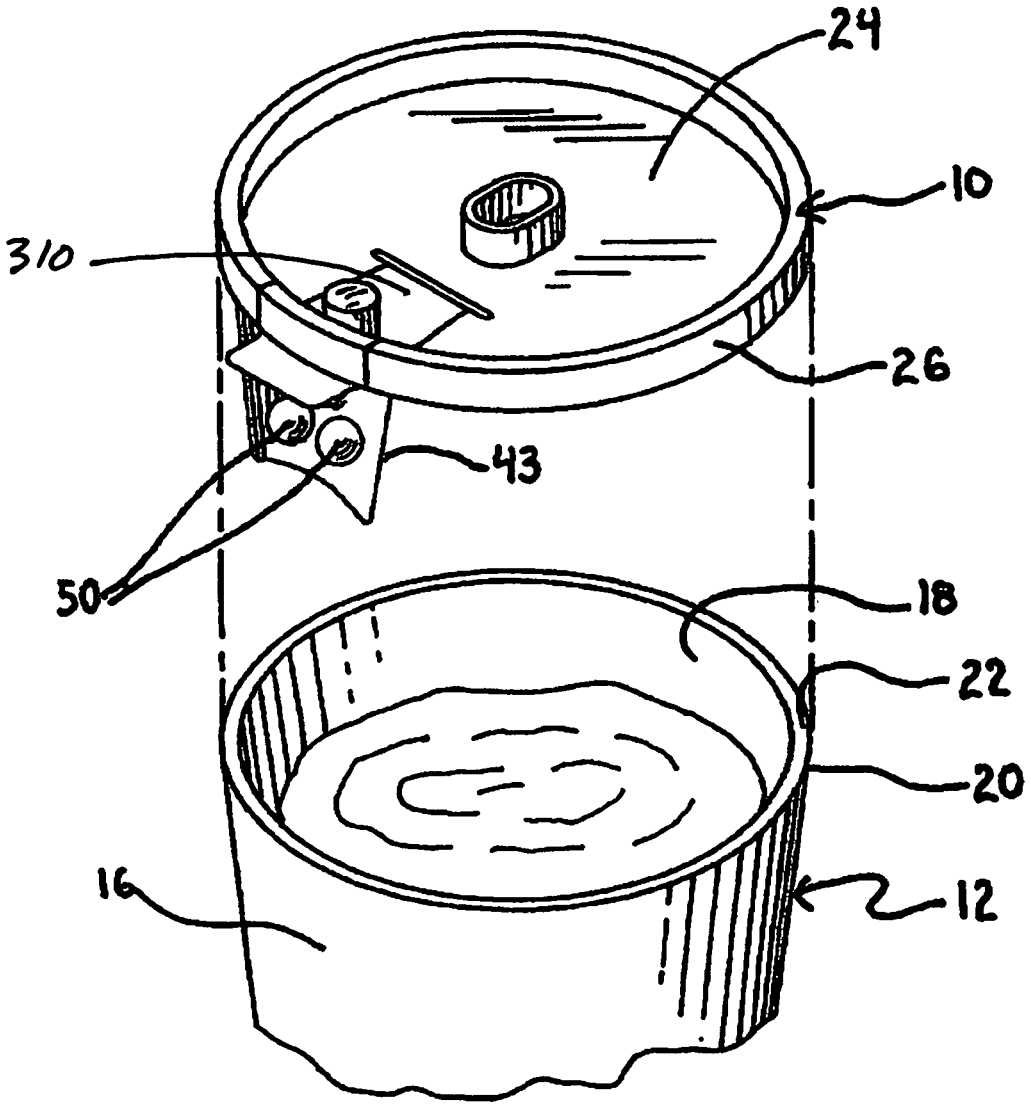
FIG. 1 is a perspective view of the preferred embodiment of the present invention and a partial view of a liquid filled drinking cup.
Figure 9:
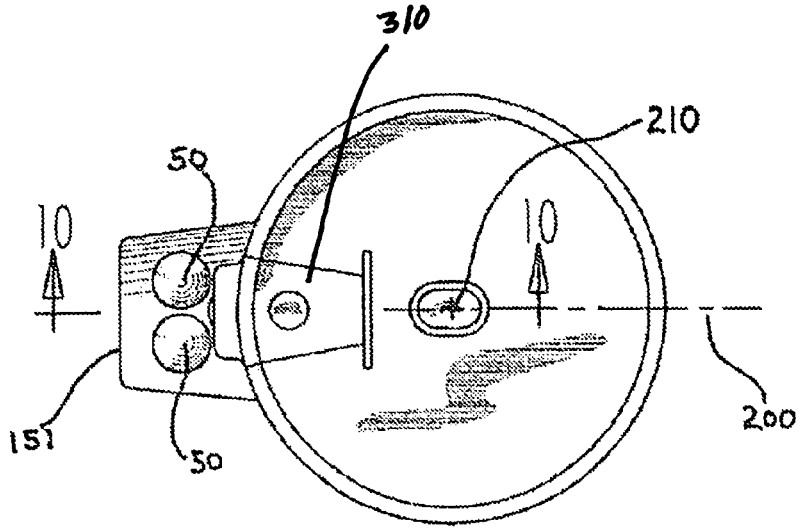
FIG. 9 is a top view of the preferred embodiment of the present invention.

Referring to FIG. 1, there is shown a top view of cup lid 10, which is the preferred embodiment of the present invention. Cup lid 10 is used with a container such as a drinking cup 12 and comprise a sidewall 16 having inner surface 18 extending vertically, top end 20, and a rim 22 which extends along the circumference of top end 20. Lid 10 comprises first part 24, which is generally flat and circular in shape and lies in a first plane. Lid 10 is normally manufactured out of a very thin thermoplastic material. A sheet of the plastic material is heated over a vacuum mold, which softens the material and forms the lid. After the vacuum forming process, the material cools and is removed from the mold as a hardened material. During the forming process, slotted or outer edge 26 is also formed along the circumference of the lid having the same dimensions as said circumference as the top circumference of the cup and, which provides means for releasably mounting first part 24 to rim 22 of top end 20 of cup 12 to form a substantially liquid tight seal between lid 10 and cup 12.

In the preferred embodiment of the present invention, there is provided a second part 28 (FIG. 3) having longitudinal axis 200 and distal end 32 depending radially outwardly from first part 24 and lying in a second plane. Second part 28 is formed out of the same thermoplastic material as the first part 24 (FIG. 2) and which is integral with or permanently mounted to first part 24. Second part 28 lies in a second plane which is co-planar with the plane as first part 24 and is centered along center longitudinal axis 200.

Figure 10:
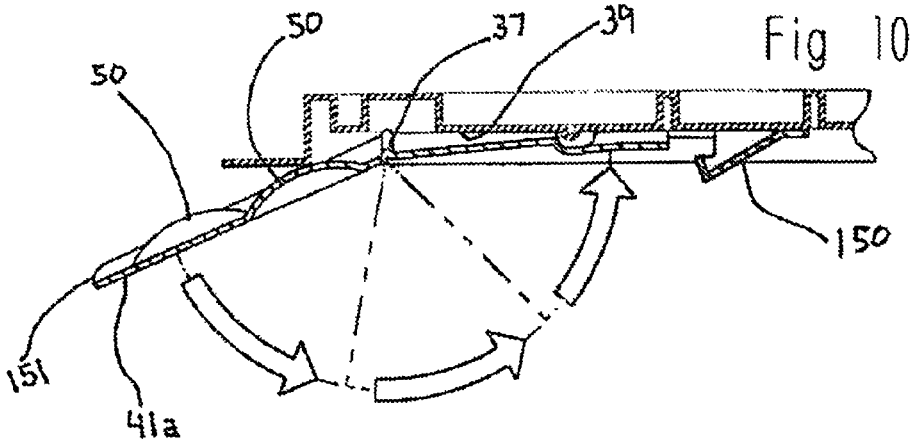
FIG. 10 is a partial cross sectional view of the preferred embodiment of the present invention taken along line 10-10 of FIG. 9.
Figure 13:
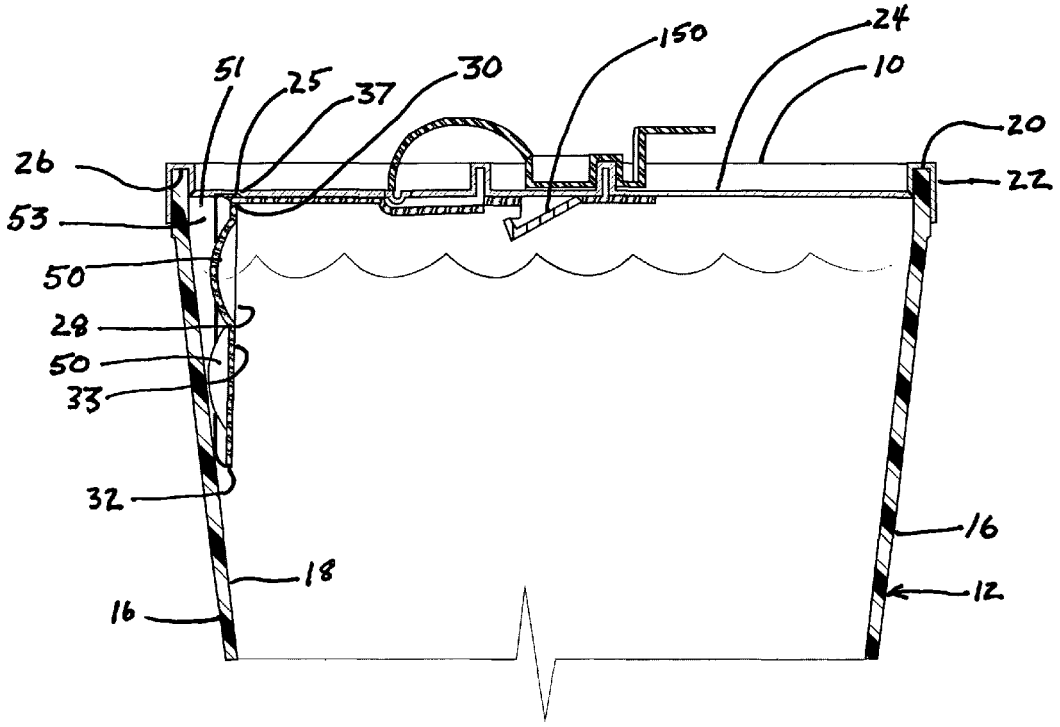
FIG. 13 is a partial cross sectional view taken along line 13-13 of FIG. 8.

Second part 28 is co-joined with first part 24 along edge 25 to comprise one continuous integral part. Second part 28 comprises a longitudinally tapered flange 29 having distal end 32 depending outwardly and away from said first part 24 in a radial direction and lyig in a second plane and proximal end 30, spaced apart and away from distal end 32, and a substantially flat surface 33, contiguous to proximal end 30. Second part 28 comprises a permanently formed longitudinal hinge means 37 which transverses in a perpendicular direction along the longitudinal axis of said second part 28 and which has a cross-sectional area in the form of channel 37. Channel 37 is formed in the lid during the manufacturing process which bifurcates lid 10 into first part 24 and second part 28. Longitudinal hinge 37 comprises means for movement of second part 28 relative to first part 24. Channel 37 is concave in cross sectional area. The open side of channel 37 and faces away from bottom surface 39. (See, FIG. 10) Channel 37's structure allows second part 28 to move freely between a first-open position 41*a* (FIG. 10) and second-closed position 41*b* (FIG. 12). Channel 37 acts as a "living hinge" so that second part 28 may move independently of first part 24. It has been unexpectantly found and determined that the constant movement of second part 28 without the addition of channel 37 causes the thermoplastic material to tear. Channel 37 prevents this tearing at end points 37*a* and 37*b* (FIG. 2). It is not desirable for end points 37*a* and 37*b* to tear since such tearing would allow for the spillage of liquid out of the cup and the premature breakage of second part 28. Second part 28 is bent in a downward direction so that when first part 24 is inserted into rim 22 of cup 12, it becomes biased against inside surface 18 of cup 12 to form a compartment 300 between inside surface 28*a* of second part 28 and inside surface 18 of cup 12 which allows the liquid in cup 12 to flow in compartment 300 and out of compartment 300. Second part 28 comprises baffle means for substantially shielding the liquid in compartment 300 from substantial interference with the liquid outside compartment 300 during lateral movement of cup of cup 12 whereby spillage of liquid out of cup 12 is reduced or lessened. Tab 310 on first part 28 moves from a first position 312 where tab 310 is mounted on rim 22 of cup 12 to prevent the liquid from escaping from compartment 53 and a second position where tab 310 is not mounted on rim 22 to allow liquid to escape from compartment 300. Aperture means 320 on the lid which is formed when second part 28 is biased against inner surface 18 of cup sidewall 16 provides a passageway for the ingres of the liquid through compartment 300 and for the egress of the liquid through said compartment 300.

Second part 28 further comprises two containers or receptacles each of which comprises a rectangular cross sectional area and which are located near the proximal end 30 of part 28 comprising a reservoir 97 which lies on bottom surface 27 of second part 28. Reservoir 97 comprises a hollow volume which his covered when tab 310 is in the first position and which is at least partially covered when tab 310 is in a second position. Reservoir 97 further comprises first container or receptacle 90 which lies perpendicular to center longitudinal axis 200 of second part 28 at proximal end 30. Second container or receptacle 92 lies perpendicular to first container 90 near proximal end 30 and along the center longitudinal axis of second part 28. First container 90 and second container 92 are concave in cross sectional area. First container 90 is larger than second container 92. The concave opening of first container 90 faces towards bottom surface 39 of first part 24. First container or receptacle 90 comprises first surface 91 with opening 93 which meets opening 95 in second container or receptacle 92 so that there is an open passageway between first container or receptacle 90 and second container or receptacle 92. Second container or receptacle 92 comprises second surface 94 with opening 96 located at the opposite end of second container or receptacle 92 spaced apart from and away from opening 95. These containers or receptacles serve two very important purposes: the first purpose is that the containers or receptacles provide an opening for air to flow between the inside of the cup and the outside of the cup to allow for the equalization of the air pressure between the inside cup air pressure and the outside air pressure. Without this opening to equalize the air pressure or gas, the liquid in the cup would pour out of the cup very easily due to the unequal air pressure outside of the cup relative to the air pressure on the inside of the cup. This is the reason that all cup lids have a small weep hole punched through the cup lid surface to equalize the air pressure.

The aforementioned receptacles serve a second important purpose, which is that the liquid in the cup can easily exit the air weep hole during normal use by splashing liquid out of the top of the cup lid and possibly onto the cup user. Neither circumstance is desirable. It has been unexpectantly found and determined that the structure of the first container or receptacle 90 and second container or receptacle 92 allows for liquid which splashes or spills into the containers or receptacles to be held in the resulting reservoirs created by the containers or receptacles. When the cup is returned to a vertical position after drinking or pouring the contents, whatever liquid remains in the containers or receptacles simply empties back into the cup.

In the preferred embodiment of the present invention, second part 28 comprises means to form aperture 51 when the lid is mounted to the cup and second part 28 is inserted inside of the cup and abuts the sidewall of the cup. Second part 28 has means for movement between first position 41*a* (See FIG. 10) and second position 215. See, FIG. 8. The design of the lid causes a biasing force in second part 28 towards the horizontal plane thereby causing second part 28 to come to rest against the inner sidewall surface 18 of cup 12 when lid 10 is mounted onto rim 22.

Referring to FIG. 6 there is shown a top view of the cup lid before the lid is attached onto a cup. A plurality of three structures or barriers 50 each having the shape of a hemisphere, are located on top surface 33 at the distal portion of second part 28. The diameter of each barrier 50 should is preferably between 0.25" to 0.375". Barriers 50 may be made out of thermoplastic material and mounted directly on second part 28 with suitable adhesives and the like, or barriers 50 may be directly formed out of the material of second part 28 during the manufacturing forming process of the lid. Referring to FIG. 8, the purpose of the barriers 50 is to interfere with or impede the flow or movement of the liquid, as it flows into and inside compartment 53 and/or during pouring, thereby substantially reducing the splashing of liquid out of aperture 51. It has been unexpectantly found, that while barriers 50 impede the flow of liquid out of aperture 51, barrier 50 does not significantly impede the flow of liquid during the normal drinking process since there is sufficient area in the aperture compartment to allow for a sufficient volume of liquid to move around and through barrier 50 to satisfy normal drinking or sipping needs. While at least one barrier 50 of a larger size then one of the three barriers, can be used in the present invention, it has been unexpectantly found that three barriers work best by allowing the liquid to flow around the serpentine channels created by the close proximity of the three barriers juxtaposed on second part 28.

Referring to FIG. 2 there is shown a clasp 150 which is either mounted to the bottom surface 33 of second part 28 or is formed as a part of the same material of second part 28 during the manufacturing process. Clasp 150 can be made in the form of a hook to or releasably hold the distal edge 151 of distal end 32 when second part 28 is moved from its first position to a second position 41*b* near said bottom surface of said first part 24. (See, FIG. 12) The purpose of using means for releasably holding second part 28 to the underside of the lid is to provide a convenient and economical mechanism to stack or package the lids vertically without having second part 28 protruding from the stacking or packaging container. Further, the use of clasp 151 has the unexpected benefit that it is very easy to release second part 28 from its latched or second position by slightly bending the sides of first part 24. Cup lid 10 is then held with one hand whereby first part 24 is essentially horizontal and then moving or bending the second part 28 (or flange 29) in a downward direction so that first part 24 and second part 28 are non-coplanar with each other. Second part 28 need only be bent or moved 90 degrees or more from the horizontal plane of first part 24 before movement is terminated in order for second part 28 to fit into cup 12. After movement of second part 28 is terminated, lid 10 is then mounted onto rim 22 by pushing slotted edge 26 onto rim 22 around the circumference of lid 10. After mounting, second part 28 comes to rest against the inner sidewall surface 18 of cup 12 thereby forming a channel 48 or compartment and the like. The liquid 54 in the cup 12 essentially flows into first aperture 56, through channel 48 and out of aperture 56 when the cup 12 is either inverted or the contents are drunk.

It should be noted that the preferred embodiment of the present invention offers no significant disadvantage over cup lids presently used in the beverage industry. For example, the added cost of manufacture of the lid is relatively insignificant since each of the design features stated herein adds a fraction of the cost of manufacture. The added de minimis cost is most certainly offset by the added convenience and unexpected advantages of the present invention which would translate into increased sales of beverages for the business establishment using the present invention. The cup lid also is easily stored in the business establishment since the lids may be stacked one on top of the other as presently done with conventional lids. Thus packaging for shipment from the manufacturer to customer will not be substantially different or inconvenient for customer.

Other embodiments and variation of the cup lid in keeping with the present invention may be realized, without departing from the sprit and scope of the appended claims.

What is claimed is:

1. A cup lid for use with a drinking cup containing a liquid, said cup having a base and a sidewall extending upwardly from the base, the sidewall including an inner surface, a top end, and a rim extending along the circumference of the top end and comprising:

a first part lying in a first plane and having a top surface and a bottom surface;

means on said first part for releasably mounting said first part to the top end of the cup to form a substantially liquid tight seal between the cup lid and the cup;

a second part having a longitudinal axis and a distal end depending radially outwardly from said first part and lying in a second plane;

compartment means formed between the inner surface of the cup and said second part for allowing liquid in the cup to flow into said compartment and out of said compartment;

said second part comprising baffle means for shielding the liquid in said compartment means from interference with most of the liquid outside said compartment means during movement of the cup whereby spillage of the liquid out of the cup is reduced minimized;

hinge means on said second part and traversing at least a part of said second part for allowing the movement of said second part relative to said first part and for substantially preventing the tearing of the lid during the movement of said second part;

a tab on said first part for movement from a first position where said tab is mounted on the rim of the cup to prevent the liquid from escaping from said compartment and a second position where said tab is not mounted on the rim to allow the liquid to escape from said compartment;

a reservoir located on the bottom surface of said second part comprising a hollow inside volume which is covered when said tab is in said first position and which is at least partially covered when said tab is in said second position;

said hinge means further comprises a channel which bifurcates the lid to facilitate the movement of said second part relative to said first part thereby reducing the tearing of the lid during the movement of said second part;

a first receptacle having at least one opening;

a second receptacle having a first opening and a second opening spaced apart and away from said first opening;

said first receptacle opening and said second receptacle first opening are joined to allow for the passage of air and fluid into and out of said reservoir;

said first receptacle is positioned transverse to said second part;

said first receptacle comprises a rectangular cross-sectional area;

said second receptacle comprises a rectangular cross-sectional area; and, said rectangular cross-sectional area of said first receptacle is larger than said rectangular cross-sectional area of said second receptacle.

2. A cup lid for use with a drinking cup containing a liquid, said cup having a base and a sidewall extending upwardly from the base, the sidewall including an inner surface, a top end, and a rim extending along the circumference of the top end and comprising:

a first part lying in a first plane and having a top surface and a bottom surface;

means on said first part for releasably mounting said first part to the top end of the cup to form a substantially liquid tight seal between the cup lid and the cup;

a second part depending radially outwardly from said first part and lying in a second plane and having a longitudinal axis and a distal end;

means on said second part for movement relative to said first part;

compartment means formed between the inner surface of the cup and said second part for allowing liquid in the cup to flow into said compartment and out of said compartment;

said second part comprising baffle means for substantially shielding the liquid in said compartment means from substantial interference with the liquid outside said compartment means during lateral movement of the cup whereby spillage of liquid out of the cup is substantially minimized;

aperture means on the lid to provide a passageway for the ingress of the liquid through said compartment and for the egress of the liquid through said compartment; and, at least one structure mounted on said baffle means which interferes with the flow of the liquid as it flows into said compartment and out of said compartment.

3. The cup lid of claim 2 wherein said structure comprises the shape of hemisphere.

4. The cup lid of claim 3 wherein said hemisphere has a diameter in the range of ¼" to ⅜".

5. The cup lid of claim 2 wherein said structure is located on the distal end of said baffle means.

6. A cup lid for use with a drinking cup containing a liquid, said cup having a base and a sidewall extending upwardly from the base, the sidewall including an inner surface, a top end, and a rim extending along the circumference of the top end and comprising:

a first part lying in a first plane and having a top surface and a bottom surface;

means on said first part for releasably mounting said first part to the top end of the cup to form a substantially liquid tight seal between the cup lid and the cup;

a second part having a longitudinal axis, a center axis and a distal end depending radially outwardly from said first part and lying in a second plane;

means on said second part for movement relative to said first part from a first to a second position;

compartment means formed between the inner surface of the cup and said second part for allowing liquid in the cup to flow into said compartment and out of said compartment;

said second part comprising baffle means for substantially shielding the liquid in said compartment means from substantial interference with the liquid outside said compartment means during lateral movement of the cup whereby spillage of liquid out of the cup is substantially minimized;

a holder located on said bottom surface of the cup lid; and, said holder comprises means for releasably mounting said distal end of said second part when said second part is moved from its first position to a second position near said bottom surface of said first part.

7. A lid for use with a container having a liquid, said container having a base and a sidewall extending upwardly from the base, the sidewall including an inner surface, a top end having a circumference and a rim extending along the circumference of the top end, and comprising:

a first part lying in a first plane and having a top surface, an outer edge and a bottom surface;

said outer edge having a circumference with the same dimensions as the circumference as the top end of the container;

said outer edge having means for attaching said lid onto the container to provide a liquid-tight seal between said lid and the container;

a second part having a top surface; a bottom surface and a distal end depending outwardly and away from said first part and lying in a second plane;

movement means on said second part which connects said first and second parts together to facilitate the movement of said second part relative to said first parts together to facilitate the movement of said second part relative to said first part and which reduces the tearing of the lid at the location of the connection of the first part and the second part;

a compartment formed between said second part and the inner surface of the container when the lid is attached to the container;

said compartment bifurcates the liquid inside said container into one portion within said compartment and another portion which is not within said compartment;

aperture means on the lid to provide a passageway for the ingress of the liquid through said compartment and for the egress of the liquid through said compartment when said lid is attached to said container;

a structure on said second part which interferes with the movement of the liquid inside said compartment; and, engagement means on the bottom surface of the lid for releasably holding said distal end of said second part to the lid during the movement of said second part.

8. A lid for use with a container having a liquid, said container having a base and a sidewall extending upwardly from the base, the sidewall including an inner surface, a top end having a circumference and a rim extending along the circumference of the top end, and comprising:

a first part lying in a first plane and having a top surface, an outer edge and a bottom surface;

said outer edge having a circumference with the same dimensions as the circumference as the top end of the container;

said outer edge having means for releasably mounting said lid onto the container to provide a liquid-tight seal between said lid and the container;

a second part having a top surface, a bottom surface, a longitudinal axis and a distal end depending outwardly and away from said first part in a radial direction and lying in a second plane;

movement means on said second part connecting said first and second parts together to facilitate the movement of said second part relative to said first part;

a compartment formed between said second part and the inner surface of the container;

said compartment bifurcates the liquid inside said container into one portion within said compartment and the other portion which is not within said compartment;

aperture means on said lid to provide a passageway into and out of said compartment when said lid is releasably mounted on said container;

a structure on said second part which interferes with the movement of the liquid inside said compartment; and, engagement means on the bottom surface of the lid for holding and releasing said distal end of said second part when said second part is moved from its first position away from the bottom surface of the lid to a second position which is near the bottom surface of the lid.

9. A lid to cover the top of a container and the container having a liquid therein, the lid comprising:

a first part lying in a first plane and having a top surface, an outer edge and a bottom surface;

said outer edge comprising a circumference;

said outer edge further comprising attachment means which traverses along said circumference;

a second part having a top surface, a bottom surface and a distal end depending outwardly and away from said first part;

movement means on said second part connecting said first and second parts together to facilitate the movement of said second part relative to said first part;

said second part being disposed within the container and spaced apart and away from said first part;

said distal end being dispose substantially contiguous to the inside of the container;

aperture means on said lid;

at least one structure on and extending away from said top surface of said second part; and, said structure comprises means for interfering with the flow of the liquid when the liquid is poured out of the container.

10. The lid in claim 9 and further comprising engagement means on the bottom surface of the lid for holding said second part to said bottom surface of the lid and for releasing said second part from the bottom surface of the lid.

* * * * *